US006463750B2

(12) United States Patent
Assaf

(10) Patent No.: US 6,463,750 B2
(45) Date of Patent: Oct. 15, 2002

(54) SYSTEM FOR DEHUMIDIFICATION OF AIR IN AN ENCLOSURE

(75) Inventor: Gad Assaf, Beer Sheva (IL)

(73) Assignee: Agam Energy Systems Ltd., Hod Hasharon (IL)

( * ) Notice: Subject to any disclaimer, the term of this patent is extended or adjusted under 35 U.S.C. 154(b) by 0 days.

(21) Appl. No.: 09/766,233

(22) Filed: Jan. 19, 2001

(65) Prior Publication Data

US 2001/0015072 A1 Aug. 23, 2001

(30) Foreign Application Priority Data

Jan. 24, 2000 (IL) ..... 134196

(51) Int. Cl.[7] ..... F25D 23/00
(52) U.S. Cl. ..... 62/271; 62/93; 62/434
(58) Field of Search ..... 62/93, 434, 271

(56) References Cited

U.S. PATENT DOCUMENTS

| | | | |
|---|---|---|---|
| 4,205,529 | A | 6/1980 | Ko |
| 4,355,683 | A | 10/1982 | Griffiths |
| 4,373,347 | A | 2/1983 | Howell et al. |
| 4,939,906 | A | 7/1990 | Spatz et al. |

FOREIGN PATENT DOCUMENTS

| | | |
|---|---|---|
| WO | WO99/26026 | 5/1999 |

*Primary Examiner*—William C. Doerrler
*Assistant Examiner*—Mark Shulman
(74) *Attorney, Agent, or Firm*—Bachman & LaPointe, P.C.

(57) ABSTRACT

The invention provides a system for the dehumidification of air in a space inside an enclosure, the system including at least one air/brine heat exchanger unit for heating cold fresh air introduced into the heat exchanger from the outside and for dehumidifying the air within the enclosure by vapor condensation; and a brine regenerator in brine communication with the air/brine heat exchanger.

11 Claims, 3 Drawing Sheets

SYSTEM FOR DEHUMIDIFICATION OF AIR IN AN ENCLOSURE

FIELD OF THE INVENTION

The present invention relates to a system for dehumidification of air in an enclosure.

BACKGROUND OF THE INVENTION

The vapor content of cold air is considerably small, e.g., 6 g/kg air, as compared with the vapor content of warm air inside an enclosure, which is typically 11 g/kg for greenhouses and 15 g/kg for enclosed swimming pools. Under these circumstances, ventilation is commonly used inside enclosures for removing humidity. Ventilation, however, also removes heat and latent heat from the enclosure. For example, removing 1 kg of water vapor in a swimming pool enclosure requires 1.2 kW of heat. In greenhouses, it requires 3 kW of heat, because plant transpiration is related to convective heating.

DISCLOSURE OF THE INVENTION

It is therefore a broad object of the present invention to provide a system for economically removing humidity inside enclosures, with the minimal removal of heat.

In accordance with the present invention, there is therefore provided a system for the dehumidification of air in a space inside an enclosure, said system comprising at least one air/brine heat exchanger unit for heating cold fresh air introduced into the heat exchanger from the outside and for dehumidifying the air within said enclosure by vapor condensation; and a brine regenerator in brine communication with said air/brine heat exchanger.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic cross-sectional view of a system for economically dehumidifying air inside an enclosure according to the invention;

FIG. 2 is a cross-sectional view of a further embodiment of a system for dehumidifying air inside an enclosure according to the invention, and FIG. 3 is a cross-sectional view of a still further embodiment of a system for dehumidifying air inside an enclosure according to the invention.

DETAILED DESCRIPTION

Figure 1:
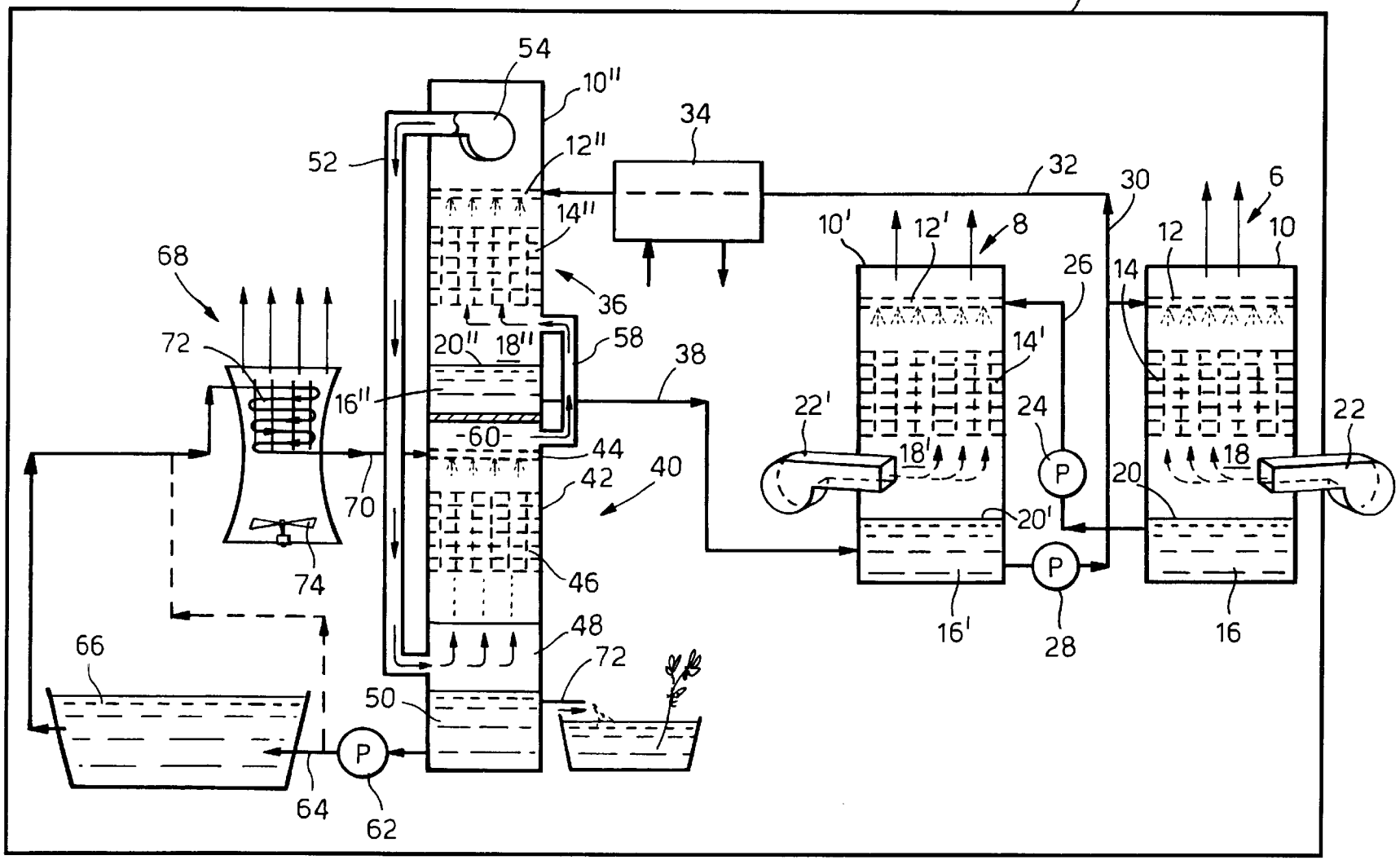

Referring to FIG. 1, there is illustrated a system 2 for dehumidifying an enclosure 4, such as a greenhouse, a swimming pool enclosure, and the like. The system includes two substantially similar heat exchanger units; a first, cold (ambient) air/warm brine heat exchanger unit 6 and a second, warm air/cold brine heat exchanger unit 8. Each of the heat exchanger units 6 and 8 are composed of a housing 10, 10' and brine liquid inlet means 12, 12', disposed in the upper portion of the housing. The liquid inlet means is advantageously embodied by a set of drip or spray nozzles or apertures. Below the brine inlet means 12, 12' there is affixed a brine/air heat exchanger 14, 14'. The latter can be made of densely folded carton paper or of packed particles, e.g., glass or ceramic pebbles or beads. The lower portion of the housing constitutes a brine reservoir 16, 16', while the space 18, 18' inside the housing, delimited by the liquid level 20, 20' and the heat exchanger 14, 14', respectively, acts as a brine dripping area exposed to ambient air introduced into the space, for example, by a blower 22, 22', or by any other natural or forced means.

Brine from reservoir 16 is fed by means of pump 24 to brine inlet means 12' via conduits 26, while brine from reservoir 16' is fed by means of a pump 28 and conduit 30 back to brine inlet means 12, as well as via conduit 32 to a brine heater 34, e.g., a hot water/cold brine heat exchanger. The heated brine proceeds to a brine regenerator 36, composed of a housing 10", brine inlet means 12", brine/air heat exchanger 14", brine reservoir 16" and brine dripping area 18". The reservoir 16" is connected by means of conduit 38 with the reservoir 16' of heat exchanger 8.

Situated adjacent to the regenerator 36 is a condenser 40, preferably an air-cold water direct contact condenser, composed of a housing 42, a liquid inlet means 44, a heat exchanger 46, a dripping area 48 and a reservoir 50. The brine regenerator 36 and condenser 40 are operatively interconnected by a conduit 52 leading from a blower 54 located inside the space 56 above the brine inlet means 12" of regenerator 36 to the dripping area 48 of condenser 40, and also connected by a conduit 58 communicating between the space 60 above the liquid inlet 44 of condenser 40 and the dripping area 18" of the generator 36.

Further seen in FIG. 1 is a pump 62 for propelling water via conduit 64 from reservoir 50 to a water cooler/air heater unit, e.g., a swimming pool 66, a water/air heat exchanger 68, or both. The water cooled by the water cooler is propelled via conduit 70 to the water inlet 44 of the condenser 40. The water cooler/air heater heat exchanger 68 consists of a coil 72 in fluid communication with conduits 64 and 70, and a fan 74. The reservoir 50 of condenser 40 is fitted with a condensed water exit 72 leading to plants inside or outside the enclosure, in case of a greenhouse, or to the outside, to be otherwise utilized.

The operation of system 2 is as follows:

Outside cold, dry air is introduced into heat exchanger unit 6. The air interacts with the warm brine and exits from the unit at about the same vapor content as that which it possessed when introduced, and at the temperature prevailing inside the enclosure 4.

The inside air interacts with the cold brine in reservoir 16. The condenser in unit 8 heats the brine. Hence, the warm brine, in turn, heats the outside air by means of the latent heat of the inside air. By this process, the brine condensation in unit 8 heats the cold brine of unit 6 and converts the latent heat into sensible heat. Thereafter, the warm brine heats the fresh air before it is introduced into the enclosure 4.

The brine from unit 8 is propelled through heat exchanger 34, where it is heated before entering the generator 36. The hot brine exchanges heat and vapor of air in a closed loop with the condenser 40. As a result, the brine evaporates while it is being cooled, and the air entering the generator at 76 collects the vapor while being heated by the brine. The hot and humid air is circulated inside the condenser 40, where water collects the vapor being heated. The warm water is further circulated in the coil 72 of the unit 70, and fan 74 blows the heat radiated from the coil into the enclosure 4. In the particular embodiment of FIG. 1, heat is also transmitted to the swimming pool 66. Condensed water exits at 72.

In the above-described manner, the regeneration unit is kept inside the enclosure, while the heat of condensation in unit 8 is introduced as sensible heat into the fresh air unit 6, before being transmitted into the enclosure.

Figure 2:
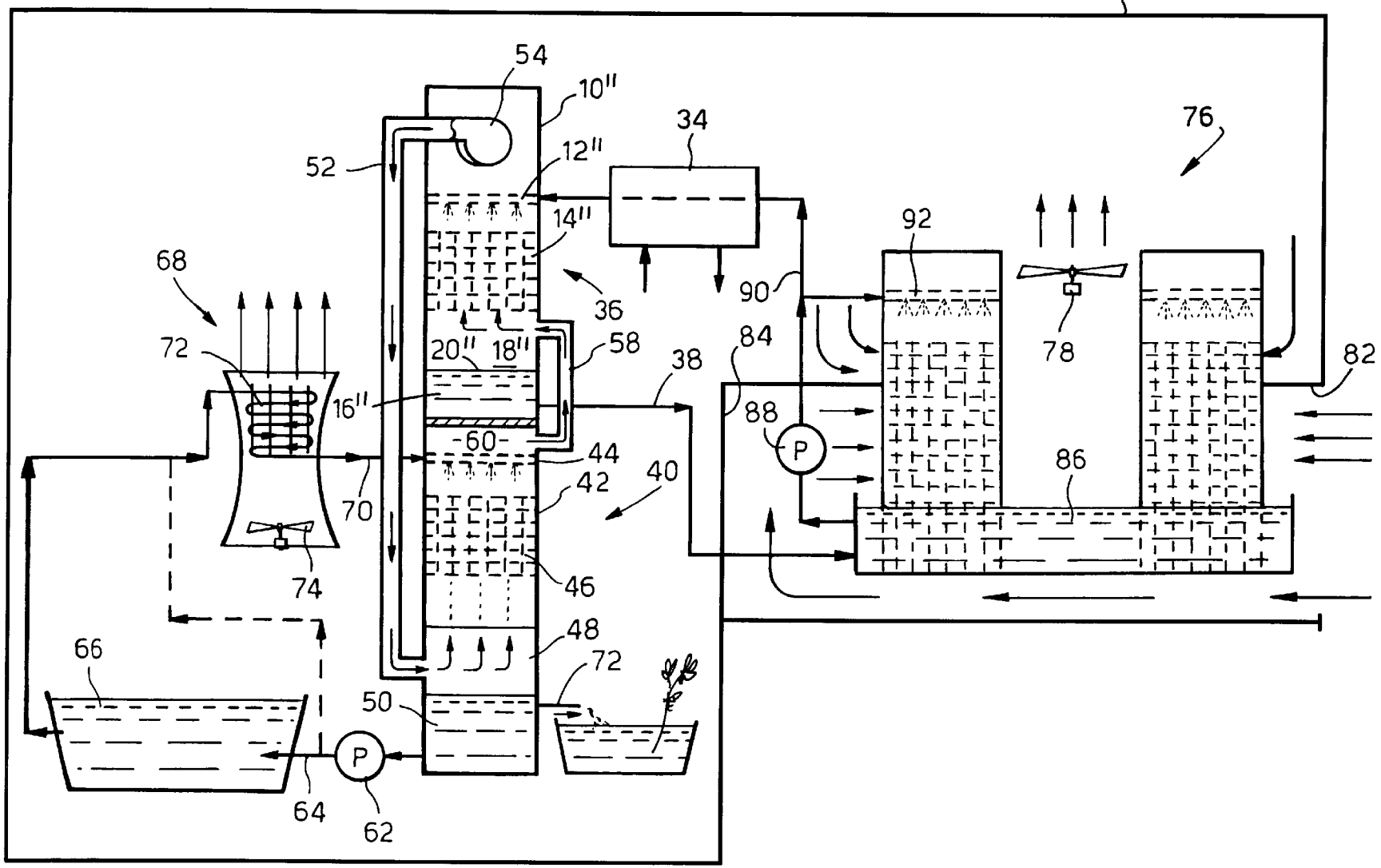

Referring now to FIG. 2, there is illustrated a slight modification of the system 2 of FIG. 1, wherein there is provided a single air/brine heat exchanger unit 76, furnished with a fan 78 for blowing out heated air from inside unit 76 to the space within the enclosure 80. As seen, the enclosure 80 has an opening 82 and a wall portion 84 encasing the lower part of unit 76. Cold outside air enters through the opening 82 and contacts the lower portion of unit 76, where it is heated by the brine and expelled into the enclosure as hot air. The upper portion of the unit is in contact with the air inside the enclosure 80. The air within the enclosure contacts the brine and heats it before it contacts the outside air. Unit 76 also includes a reservoir 86 and a pump 88 for elevating the brine from the reservoir 86 through conduit 90 to brine inlet means 92. The remainder of the system and its operation is similar to that described above with regard to FIG. 1.

Figure 3:
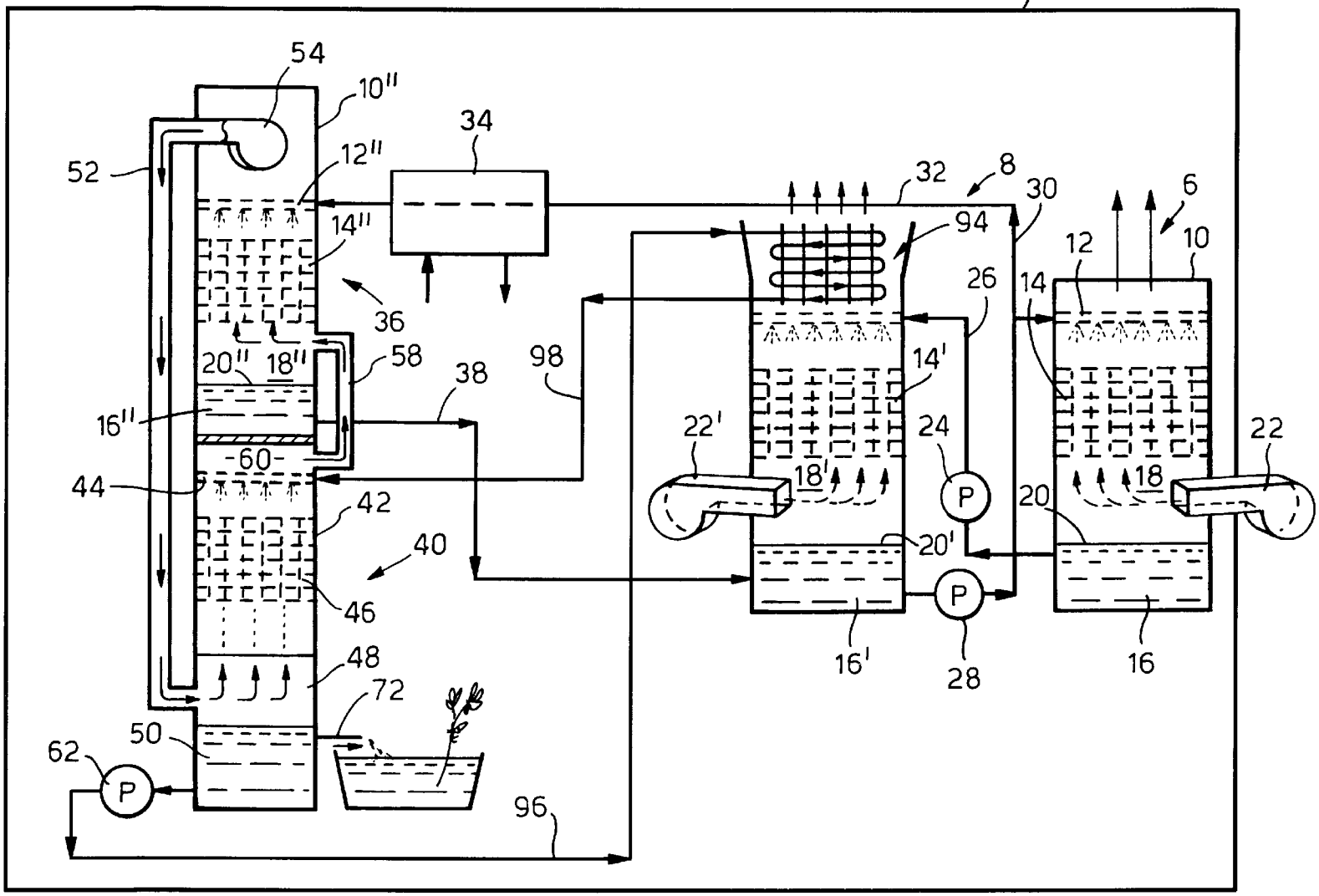

In FIG. 3, there is shown a still further embodiment of the invention, in which, instead of utilizing the water/air heat exchanger 68, the water in condenser 40 is cooled by means of an air/water heat exchanger 94 arranged at the top portion of heat exchanger 8, thereby making use of the blower 22'. The water from reservoir 50 is propelled via conduit 96 by means of pump 62 to the heat exchanger 94, where it is cooled and returned through conduit 98 to the water inlet 44 of condenser 40.

In order to keep the brine at the correct concentration, the temperature of the brine which flows into the regenerator 36 should not be too high and not too low. The brine temperature can be controlled by the brine heater 34.

In addition, the brine flow rate to the regenerator 36 should not be too high. The brine exiting the regenerator at high temperature will increase its vapor pressure. When the brine flow rate into or from the regenerator is large, compared with the brine flow rate heat exchanger units 6, 8 or 70, then the brine temperature at the reservoir 16' or 86 will be elevated and, as a result, the vapor pressure of the brine at heat exchanger unit 6 will increase, the vapor content of the fresh air entering the enclosure will also increase, and the dehumidification rate is reduced.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A system for the dehumidification of air in a space inside an enclosure, said system comprising:

at least one air/brine heat exchanger unit for heating cold fresh air introduced into the heat exchanger from the outside and for dehumidifying the air within said enclosure by vapor condensation; and a brine regenerator in brine communication with said air/brine heat exchanger.

2. The system as claimed in claim 1, further comprising:

a water condenser in closed-loop air communication with said brine regenerator, and a water cooler/air heater unit located inside the enclosure in water communication with said condenser, operable to transmit heat from the regenerator to the space inside the enclosure.

3. The system as claimed in claim 1, wherein said cold fresh air is introduced inside said heat exchanger unit by means of a blower.

4. The system as claimed in claim 1, wherein said cold fresh air is introduced into a portion of said heat exchanger by means of an opening in said enclosure.

5. The system as claimed in claim 1, further comprising a blower for introducing air from the space inside the enclosure into said heat exchanger unit.

6. The system as claimed in claim 1, further comprising a brine heater coupled to a conduit leading from said heat exchanger unit and said regenerator.

7. The system as claimed in claim 1, wherein said regenerator is constituted by a heat exchanger unit having an air blower for propelling air from the top portion of said heat exchanger unit to the lower portion of said condenser.

8. The system as claimed in claim 1, wherein said condenser is provided with water outlet means for disposing of condensed water.

9. The system as claimed in claim 2, wherein said water cooler/air heating unit is constituted by a swimming pool.

10. The system as claimed in claim 2, wherein said water cooler/air heating unit is constituted by a water conduit and a fan directing air through said conduit.

11. The system as claimed in claim 2, wherein said water cooler/air heating unit is arranged at the top portion of said air/brine heat exchanger.

* * * * *